US007258635B2

(12) United States Patent
Brandes

(10) Patent No.: US 7,258,635 B2
(45) Date of Patent: Aug. 21, 2007

(54) SHUTTLECOCK

(76) Inventor: Ulrich Wilhelm Brandes, Friesickestr. 29, Berlin (DE) 13086

( * ) Notice: Subject to any disclaimer, the term of this patent is extended or adjusted under 35 U.S.C. 154(b) by 0 days.

(21) Appl. No.: 10/561,553

(22) PCT Filed: Apr. 15, 2004

(86) PCT No.: PCT/EP2004/003977

§ 371 (c)(1),
(2), (4) Date: Dec. 20, 2005

(87) PCT Pub. No.: WO2005/000428

PCT Pub. Date: Jan. 6, 2005

(65) Prior Publication Data

US 2006/0199683 A1 Sep. 7, 2006

(30) Foreign Application Priority Data

Jun. 25, 2003 (DE) ..... 203 10 037 U

(51) Int. Cl.
*A63B 67/18* (2006.01)

(52) U.S. Cl. ..... 473/579

(58) Field of Classification Search ..... 473/579, 473/580

See application file for complete search history.

(56) References Cited

U.S. PATENT DOCUMENTS

| | | | | |
|---|---|---|---|---|
| 2,666,643 | A * | 1/1954 | Miller | 473/580 |
| 3,089,704 | A * | 5/1963 | Wolf | 473/579 |
| 4,538,818 | A * | 9/1985 | Sinclair | 473/579 |
| 5,562,290 | A | 10/1996 | Wei | |
| 5,924,943 | A | 7/1999 | Sklar | |

FOREIGN PATENT DOCUMENTS

| | | | |
|---|---|---|---|
| CH | 672 430 | A5 | 11/1989 |
| DE | 231763 | | 6/1910 |
| DE | 23 21 861 | | 11/1973 |
| DE | 33 29 205 | A1 | 2/1984 |
| DE | 91 10 804.7 | U1 | 4/1992 |
| DE | 93 09 431 | U1 | 9/1993 |
| DE | 196 46 508 | A1 | 5/1998 |
| GB | 887172 | | 1/1962 |
| GB | 908684 | | 10/1962 |
| GB | 1046708 | | 10/1966 |
| WO | 92/05843 | | 4/1992 |
| WO | 01/17620 | A1 | 3/2001 |

* cited by examiner

*Primary Examiner*—John A. Ricci
(74) *Attorney, Agent, or Firm*—Christa Hildebrand; Norris McLaughlin & Marcus, P.A.

(57) ABSTRACT

The invention relates to a shuttlecock comprising a conical crown (2) and a base (3) for hitting. In order to modify the flying characteristics, a preferably toroidal ring (4) which is made of an elastic material is mounted on the shuttlecock (1) in a biased state so as to surround the crown (2). Said ring is preferably retained in a fixed position by means of the rear limit of the base (3) and the forward zone (21) of the crown (2), rear and forward being in relation to the flying direction. The forward zone (21) of the crown (2) can be formed by stems (21), for example. Alternatively, several rings can be provided. The invention allows the flying characteristics of the birdie to be modified in a particularly simple and fast manner. The birdie can be made to fly in a more stable fashion by means of the weight of the ring, for example, resulting in greater speeds and ranges.

17 Claims, 12 Drawing Sheets

FIG. 2a
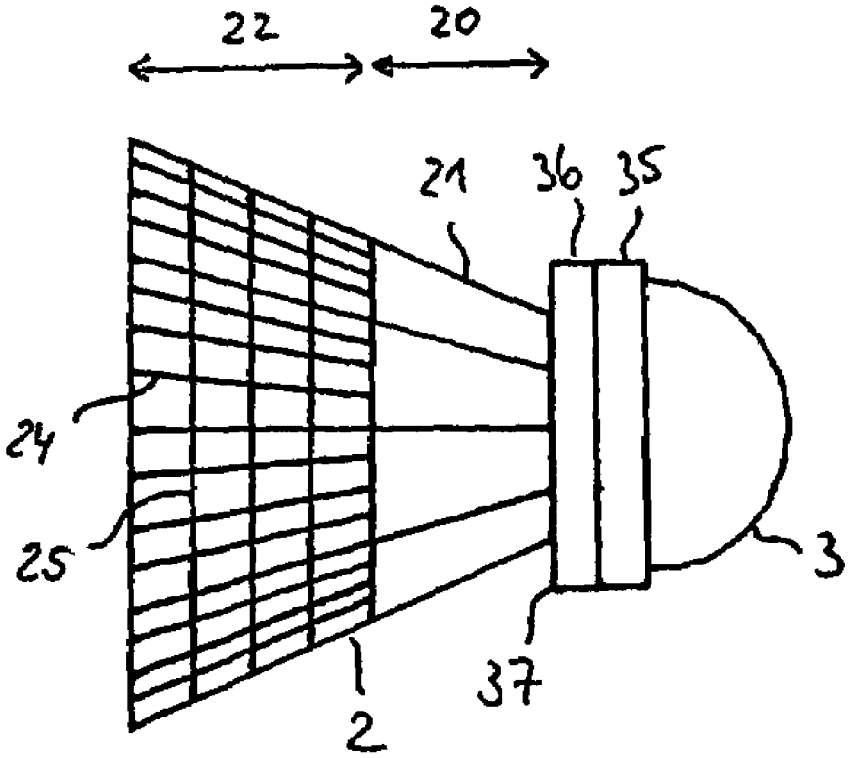
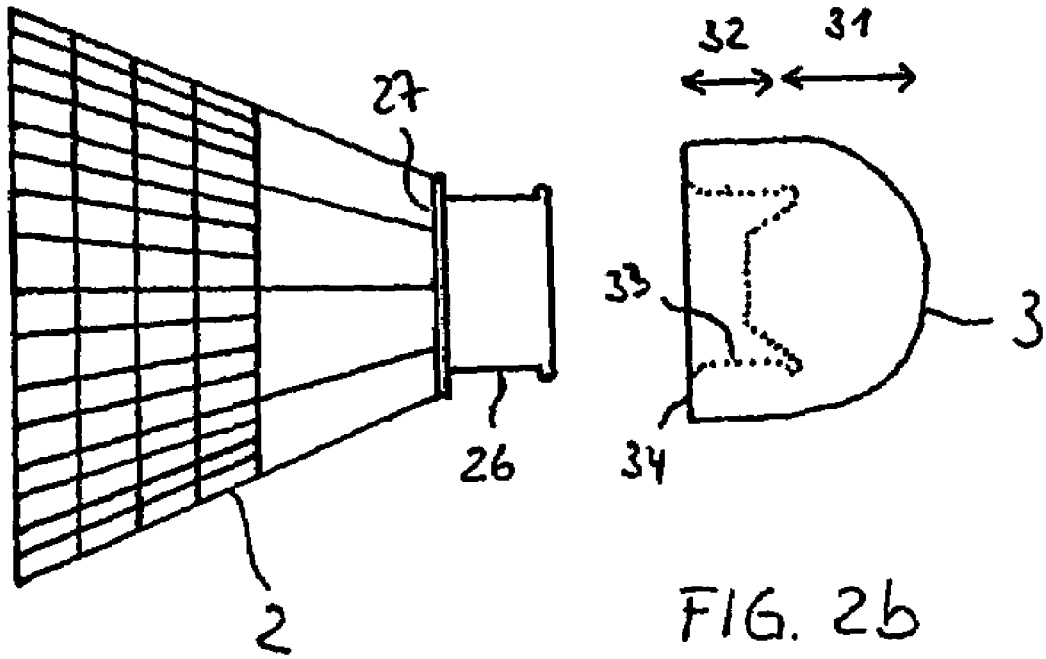
FIG. 2b

SHUTTLECOCK

BACKGROUND OF THE INVENTION

The invention relates to a shuttlecock with an essentially conical crown, wherein the crown has an integrally formed attachment element formed in the region of the narrow end of the crown, and with a striking cap which is dome-shaped at least in a front region, as viewed in the flight direction, and is anchored in the attachment element.

In the context of the present description, "shuttlecock" refers to an aerodynamic object which can be used for ballgames, or as an implement in a ballgame, or a part of a ballgame. The shuttlecock can, in particular, have the shape of a badminton ball, whereby the crown of the shuttlecock corresponds to the skirt of the badminton ball.

The literature does not employ uniform terminology when referring to the various components of the aerodynamic object of interest, so that these terms need to be more clearly defined in the present description. Because of the close relationship with competitive badminton, reference for further clarification is made to the corresponding expressions used in badminton. It should also be pointed out in this context that occasionally several different terms are used for the same part or component and that not all commonly used terms are exhaustively recited in the present description.

In the context of the present description, the typical flight direction is referred to as "forward", so that the striking cap of the shuttlecock is located in the "front" and the crown is located in the "rear." The conical crown therefore has in the "forward" direction a narrow region and in the "rearward" direction a wide region.

In the following, similarities and potential differences between "shuttlecock" and "badminton" shuttle will be described. A discussion of the differences will also explain why the term "shuttlecock" instead of the term "badminton" is selected in this case.

Regarding the conventional terminology used in badminton, reference is made to the following terms used in the English language: the skirt of a badminton ball is typically referred to as "skirt." The base of a badminton ball is typically referred to as "striking cap." According to the rules for competitive badminton, the badminton ball as a whole is referred to as "shuttle" which has a "skirt" and a "base", with the base being referred to in the context of the present specification as striking cap.

The crown of the shuttlecock and the skirt of the badminton ball can be made of feathers or of a man-made material. When using natural material, in particular feathers, for example goose feathers, the feathers can be placed into the striking cap with their (stripped) quills. The striking cap can be made, for example, of cork. The crown or skirt can then be subdivided into a front section, which is formed by the front sections of the quills, and an abutting rear section, which is formed by the feather barbs. This region of the feather barbs is typically referred to as "vane area."

When using man-made material, for example plastic, the crown or skirt is frequently constructed so that it can likewise be divided into sections, similar to the crown/skirt made of feathers, wherein the front section can be formed of "stems" which essentially correspond to the front section of the quills and diverge towards the rear at an angle, as viewed from the striking cap, conforming to the conical basic shape of the crown or skirt. The crown or skirt section formed by the stems is referred to, for example, as "upper skirt." An additional section, which corresponds to the vane area for a crown or skirt made of feathers, can abut the front crown or skirt section. In addition to the rear sections of the stems, the vane area can include, for example, ribs which interconnect the stems in the transverse direction, as well as connecting ribs extending essentially parallel to the stems, thereby forming an approximately network-like structure which forms the approximately conical basic shape in this section.

An end ring, which can be formed, for example, as a disk or an annular disk and connect the stems with each other, can be provided in the front region of the crown or skirt, i.e., in the front end section of the stems. The diameter of the end ring is typically slightly smaller than the diameter of the striking cap. The or a fastening element, which serves as a connection or anchor with the striking cap, can be integrally formed on the end ring as a forward-pointing shoulder. For example, an approximately cylindrical attachment pin, referred to as "stem extension collar," can be provided, with a diameter of approximately half the diameter of the striking cap.

A front section of the striking cap can have a forwardly extending dome-shaped element, and a rear section of the striking cap can have an approximately cylindrical shape. The diameter of the cross-sectional area of the cylindrical section corresponds essentially to the base diameter of the dome-shaped element.

The striking cap can also have a rear opening formed, for example, as a hollow cylinder and adapted to receive a correspondingly shaped fastening element. In this way, an approximately ring-shaped rear boundary wall can be formed on the striking cap which, when assembled, abuts the region of the front stems and/or the end ring.

Examples describing the aforedescribed conventional features are provided in the following publications GB 887,172, GB 908,684, GB 1,046,708, DE 2 321 861.

The differences or possible differences between a badminton ball and a shuttlecock will now be described.

The badminton rules stipulate that a badminton ball includes either real feathers or a corresponding feather imitation made of a synthetic material. When using feathers, 16 feathers must be employed having a uniform length of between approximately 62 to 70 mm, and the quills must be located on a circle having a diameter between 58 and 68 mm. The diameter of the base must be between 25 and 28 mm, and the weight of the badminton shuttle must be between 4.74 and 5.50 grams.

Rules similar to these badminton rules also apply to badminton shuttles made of a synthetic material, except that deviations of up to 10 percent are tolerated.

However, in the context of the present description, the aforementioned badminton rules do not apply to a shuttlecock according to the invention.

For example, a shuttlecock according to the invention can have a greater weight than the aforedescribed badminton ball, in particular a weight of between 6 and 50 grams, for example approximately 9 grams. The dimensions of a shuttlecock can also be different from those stipulated by the badminton rules. For example, the outside surface of the crown of a shuttlecock can have a length of between 30 and 50 mm, for example approximately 38 mm. Moreover, a circle formed by the rear boundary of the crown can, for example, have a diameter between approximately 40 and 68 mm, for example approximately 50 mm. The diameter of the striking cap can also be less than, for example, 25 mm, for example approximately between 20 and 25 mm.

Due to the aforedescribed deviations, the shuttlecock can have aerodynamic properties different from those of a badminton shuttle. In particular, the higher weight and "shorter" crown can give the trajectory an overall greater stability, thus achieving greater airspeed and a greater range. For example, the increased stability can advantageously reduce the sideways drift in crosswinds. With the aforementioned qualitative changes in the flight characteristic, the shuttlecock can advantageous be used under atmospheric or "outdoor" conditions, as opposed to the "indoor" conditions for badminton.

FIGS. 2*a*, 2*b*, and 3*a* show schematically a conventional shuttlecock of the aforedescribed type. FIG. 2*a* shows a striking cap 3 and a crown 2 abutting the rear end of the striking cap 3. The crown 2 has a front crown section 20 which abuts the striking cap 3. The front crown section 20 is formed by front sections of stems 21. A rear crown section 22 which is formed by the rear portions of the stems 21, transverse ribs 25 and connecting ribs 24, is arranged rearward of the front crown section 20. (Not all the illustrated stems 21, ribs 25 and connecting ribs 24 are provided with reference symbols so as not to overcomplicate the drawing. The illustrated number of stems 21, ribs 25 and connecting ribs 24 in the figures is also to be understood as merely illustrative and not limiting in any way).

A different number of stems 21 can be provided, for example 16 stems. In addition, for example, five ribs can be provided, and six connecting ribs 24 can be disposed in region between two corresponding stems 21.

FIG. 2*b* shows schematically an exploded view of the shuttlecock with the striking cap 3 removed. The forward ends of the stems are held together by an end ring 27. The front region of the end ring 27 has an integrally formed, essentially cylindrical fastening pin 26.

The striking cap 3 can be divided into a front dome-shaped section 31 and a following substantially cylindrical rear section 32. The striking cap 3 has a rear opening 33 adapted to receive the fastening pin 26. The opening 33 has a circular edge, so that the striking cap 3 forms a ring-shaped rear wall 34.

The connection between the crown 2 and the striking cap 3 can be improved by providing, for example, two compression rings, a front compression ring 35 and a rear compression ring 36. However, only a single compression ring may be provided.

FIG. 3*a* shows schematically a perspective view of the shuttlecock of FIGS. 2*a* and 2*b*, whereby identical elements are indicated with the same reference symbols. More particularly shown is the ring-shaped rear wall 34 of the striking cap 3, with the end ring 27 arranged following the inner boundary or edge of the striking cap 3 when the shuttlecock is assembled. The front ends of the stems 21 are connected to the end ring 27.

The striking cap can be made, for example, of thermoplastic polyolefins, polyethylene or polypropylene, in particular TBE-EPDM. The crown can also be made of plastic.

Regarding the aforedescribed conventional shuttlecocks, reference is made to the international PCT applications WO 92/05843 A1 and WO 01/17620 A1.

WO 92/05843 A1 describes a shuttlecock having a light source. The light source emits light most effectively in the flight direction.

The shuttlecock described in WO 01/17620 A1 has a radially protruding, flange-like rim disposed on the front end of a cylindrical fastening pin for firmly connecting the striking cap with the crown. This document also discloses compression rings made of a rigid plastic material and being secured in a rear cylindrical region of the striking cap by an elastic deformation of the cap material.

The German utility model G 93 09 431 U1 discloses an aerodynamic striking cap with dimple-shaped indentations on the surface which are oriented in the flight direction for improving the aerodynamic properties. A hole can be provided instead of a central dimple. This document also suggests that a neck in the striking cap which abuts the rear section of the striking cap can include on the surface a ring-shaped dimple in a signal color.

The German utility model DE 91 10 804 U1 discloses a shuttlecock with an interchangeable cylindrical core. The core is used to stabilize the flight characteristic.

The German utility model DE 33 29 205 U1 discloses a shuttlecock with a weighting element made of plastic. The weighting element can be attached to a disk-shaped anchor plate located on the inside of the crown. The weighting element can be used to alter the playing characteristic of the shuttlecock.

The German published patent application DE 106 46 508 A1 discloses a ballgame, wherein the ball is configured according to a shuttlecock or badminton ball and includes a headpiece with a spherical surface. The headpiece forms a contact surface for the face of a racket. The ball also has a feather section with several two-dimensional elements that stabilize the flight. The flight characteristic, such as the range, trajectory, speed and/or stability of the ball, can be altered by interchanging the headpieces and/or spacers mounted between the headpiece and the feather section.

SUMMARY OF THE INVENTION

It is therefore an object of the invention to improve a shuttlecock of the aforedescribed type, in particular its flight characteristic. The proposed solution should be economical and simple, while improving the flight characteristic.

The object is solved by the invention by the features of the independent claim. The dependent claims recite particular advantageous embodiments following the basic idea of the invention.

According to the invention, a shuttlecock with an approximately conical crown is disclosed. The crown includes an integrally formed fastening element disposed in a region of the small end of the crown. The shuttlecock also includes a striking cap, which is essentially dome-shaped at least in a front section, when viewed in the flight direction, and which is anchored in the fastening element. The shuttlecock further includes at least one ring which is releasably attached to the crown and surrounds the crown.

The conical crown can have, for example, essentially the shape of a straight truncated cone, whereby the fastening element can then be integrally formed in the region of the smallest cross-sectional area of the surface. The crown can also be divided into several sections, wherein the front section of the crown can be formed by several stems, for example 16 stems. A rear section of the crown can have a structure of a greater density, which can be implemented, for example, as a network structure formed by ribs and connecting ribs.

The fastening element can, for example, also have the shape of an approximately cylindrical fastening pin which is connected with the front ends of the stems, for example, by an end ring. The cylindrical fastening pin can be arranged symmetrically with respect to a major symmetry axis of the crown.

The striking cap can have two sections, whereby a font section can be shaped essentially as a forward-pointing dome-shaped element, with a rear section being essentially cylindrical. The rear section can have a cylinder diameter corresponding to the diameter of the base of the dome-shaped element. A recess or opening for connecting to the fastening element can be provided near the rear boundary of the cylindrical section. The recess can essentially be shaped as a hollow cylinder. In this way, the striking cap can have a rear boundary wall which is essentially ring-shaped and extends between the rear outer edge of the cylindrical striking cap section and the edge of the recess.

The flight characteristic of the shuttlecock can be easily changed by applying the (at least one) ring. In particular, the applied ring increases the weight of the aerodynamic object which enhances the stability of the flight trajectory. The increased weight also allows the shuttlecock to achieve greater speed and a longer range. Due to the symmetric shape of the ring, the additional weight can be distributed symmetrically with respect to a major axis of the shuttlecock, i.e., axially symmetric. Advantageously, this can also improve the flight characteristic. Conversely, an asymmetry in the weight distribution would make it more difficult for a player to anticipate the flight characteristic.

The flight characteristic of the shuttlecock can be altered individually by selecting a ring with a suitable weight. In this way, the flight characteristic can be adapted to the individual capabilities of a player. For example, particularly experienced players can achieve a high airspeed by applying a relatively heavy ring weighing, for example, between approximately 1 gram and 20 grams. A high airspeed can generally more effectively train a player's reaction and response. Conversely, inexperienced players may use a ring with a smaller weight.

Preferably, the position of the at least one ring is secured after installation, on one hand, by the conical exterior surface of the crown and, on the other hand, by a rear boundary wall of the striking cap, and held in place by an applied pretension.

Advantageously, the ring can thereby be firmly affixed to the shuttlecock. This provides stability both in the flight direction and opposite to the flight direction. The position of the ring relative to the rest of the shuttlecock can thus be reliably maintained, in particular, when the shuttlecock is struck by a racket and the like, deflecting it from its original trajectory. The ring attached in this manner can also be referred to as "intermediate ring." The "added" weight is preferably disposed symmetrically behind the approximately hemispherical striking cap.

In the transition region from the striking cap to the crown, the shuttlecock can be shaped so as to produce vortices during flight, which can slow down the shuttlecock during flight. This situation can occur, for example, when the diameter of the rear outer edge of the striking cap is greater than the diameter of the section of the crown abutting the striking cap. Vortex formation can be effectively reduced by placing the ring in this transition region. This can also prevent vortices from slowing down the shuttlecock.

Striking the aforedescribed rear outer edge of the striking cap with a racket and the like may disadvantageously deflect the shuttlecock onto an essentially unpredictable flight trajectory. The applied ring can at least partially eliminate or reduce this undesirable effect.

For example, the section of the crown which holds the ring can be formed by a front section, i.e., by the front ends, of the stems. The rear boundary wall of the striking cap can be formed, for example, by an essentially ring-shaped wall extending between a rear outer edge of the striking cap and the edge of a recess in the striking cap adapted to receive the fastening element.

Advantageously, the at least one ring can be made of an elastic material.

The connection between the ring and the rest of the shuttlecock can be particularly easily implemented with an elastic material. For example, the material can be selected so that the ring can be applied manually, in particular without using a tool and the like. The same applies for removing or releasing the ring from the rest of the shuttlecock.

Preferably, the inside diameter of the at least one ring can be smaller than the outside diameter of the striking cap, or optionally the cylindrical rear section of the striking cap. When suitably sized, the at least one ring can be easily applied manually by moving the ring from the front across the striking cap to its intended position.

Advantageously, the outside diameter of the at least one ring can be greater than the outside diameter of the striking cap, which can significantly enhance the visual appearance of the shuttlecock. For example, an approaching shuttlecock can be identified much earlier under otherwise identical conditions.

Firmly, the at least one ring can be made of thermoplastic polyolefins, polyethylene, polypropylene, EPDM, TBE-EPDM, or rubber. These materials have proven to be reliable in practice.

Advantageously, the at least one ring can have a substantially toroidal surface. This allows the ring to be easily installed and removed, because due to its toroidal shape, the ring can be easily rolled over the striking cap, which facilitates installation or removal.

Preferably, the at least one ring can have a weight of approximately between 10 and 70 percent of the weight of the shuttlecock without an installed ring. This range of values has proven advantageous in practice.

Advantageously, the at least one ring can have a weight of approximately between 1 and 25 grams, preferably between 1 and 3 grams. The shuttlecock without the applied ring can then have a weight of, for example, 5 to 15 grams, in particular approximately 9 grams.

Advantageously, the material of the at least one ring can have a Shore value in the range of approximately 40 to 90, preferably approximately 70.

Advantageously, the at least one ring can have an outside diameter of approximately 25 to 70 mm, preferably 25 to 65 mm and an inside diameter of approximately 15 to 40 mm, preferably 15 to 25 mm.

Advantageously, the exterior surface of the crown can have a length of approximately between 33 and 43 mm, and the striking cap can have a diameter of approximately between 20 and 30 mm. Moreover, the crown can have approximately the shape of a straight truncated cone, and the surface of the base covered by the cone can have a diameter of approximately 45 to 55 mm. The base surface corresponds here to the circular area bounded by the rear edge of the crown.

Advantageously, several rings, for example approximately two or three or four rings, can be applied, which can be made of the same material and can have the same dimensions. In this way, the flight characteristic of the shuttlecock can be easily affected in many different ways.

Advantageously, several rings with different dimensions and/or made of materials having different densities can be applied.

If several rings are applied, the flight characteristic can be changed in numerous ways. For example, the flight characteristic can be fine-tuned to the particular playing experience of a player.

Advantageously, the at least one ring can emit light; for example, its surface can include a luminous or signal color. The shuttlecock can then be more easily recognized, particularly when detecting an airborne, inward bound shuttlecock, which can aid in an early identification of the shuttlecock. This is particularly important for relatively high air speeds.

Advantageously, the striking cap can also include a hole, whereby an impinging airflow can produce acoustic resonances. For example, the shape of the striking cap can be essentially rotationally symmetric, with the hole located on the rotation or symmetry axis. For example, with a diameter of the striking cap between approximately 20 and 50 mm, the hole can have a diameter of between approximately 3 and 10 mm.

Additional features, advantages and characteristics will now be described with reference to a detailed description of an embodiment and with reference to the figures of the appended drawings.

BRIEF DESCRIPTION OF THE DRAWINGS

FIGS. 2*a* and 2*b* show a conventional shuttlecock.

DETAILED DESCRIPTION OF THE PRESENTLY PREFERRED EMBODIMENTS

Figure 1:
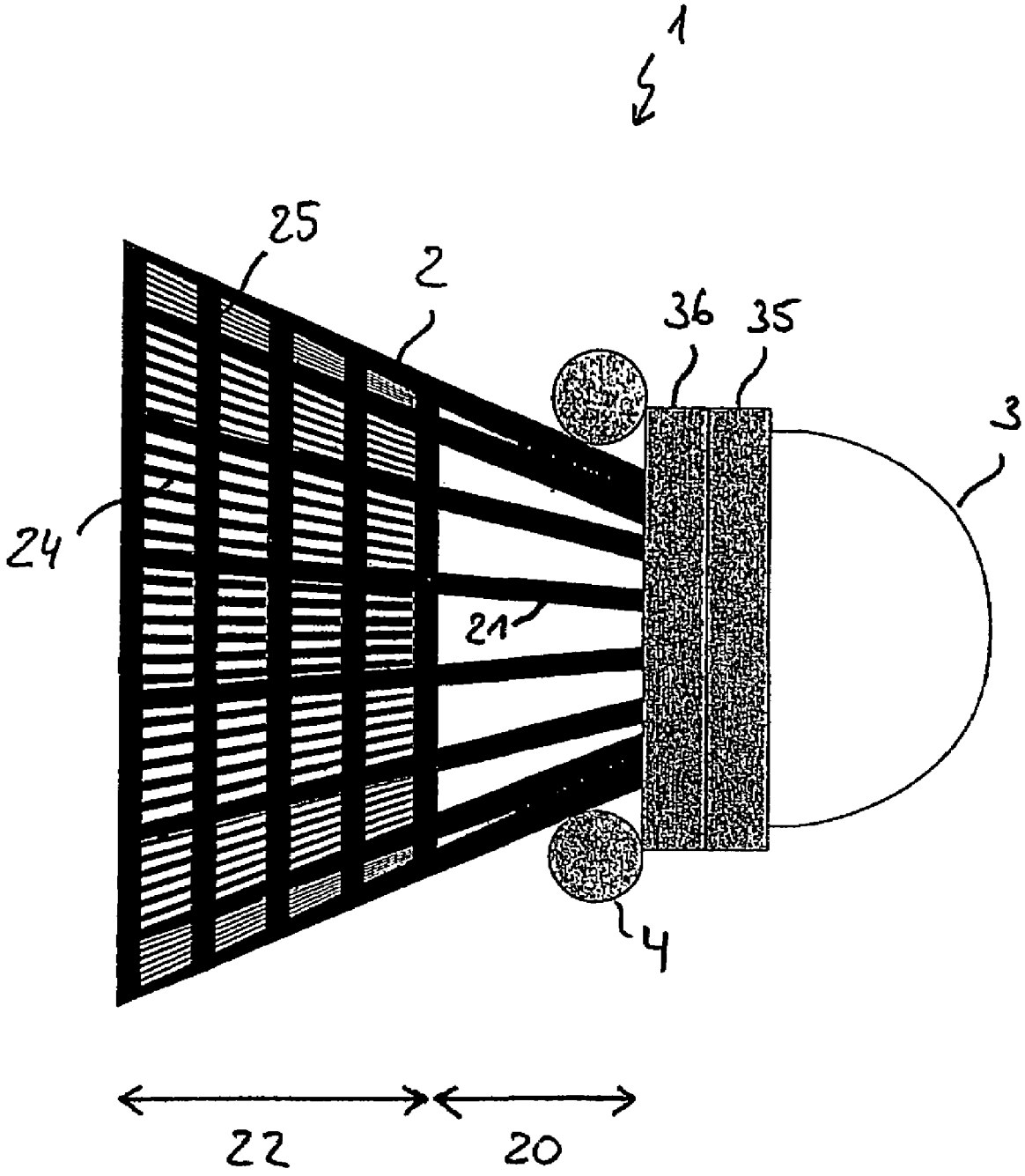
FIG. 1 shows schematically a side view of a shuttlecock according to the invention.

FIG. 1 illustrates schematically in a side view of a shuttlecock 1 according to the invention. The shuttlecock 1 can be used as a ball for ballgames played with, for example, a racket. For example, the shuttlecock can be used for outdoor play.

In the illustrated exemplary embodiment, the shuttlecock 1 is constructed of a crown 2, which is essentially formed as a straight truncated cone, a striking cap 3, and a ring 4. In this embodiment of the invention, the crown 2 and the striking cap 3 of the shuttlecock 1 have, unless indicated otherwise, the conventional features listed in the foregoing description with reference to FIGS. 2*a*, 2*b*, and 3. Accordingly, express reference is made to the sections of the foregoing description.

The crown 2 is divided into a front section 20 and a rear section 22, whereby the front section 20 is formed by several, for example sixteen, stems 21, and the rear section 22 has a network-like structure formed by the rear portions of the stems 21, the connecting ribs 24 and the ribs 25. The number of stems 21, connecting ribs 24 and ribs 25 is indicated only schematically in the Figure. For example, six connecting ribs 24 can be formed between two corresponding stems 21 in the rear crown section 22, and a total of five circular ribs 25 can be provided. The front section of the crown 2 includes a fastening pin 26 which is connected with the front stem ends by an end ring 27.

The striking cap 3 has an opening 33 formed essentially as a hollow cylinder. The striking cap 3 can also include compression rings 35 and 36 capable of reinforcing and/or securing the connection between striking cap 3 and crown 2. Such compression rings 35, 36 are known in the art.

More particularly, the shuttlecock 1 according to the invention includes a toroidal ring 4 surrounding the crown 2. FIG. 1 shows the ring 4 only schematically in cross-section so as not to obscure the overall structure. The ring 4 in this embodiment is applied in the region of the opening 33 in the striking cap.

According to the illustrated embodiment, the rear wall 34 of the striking cap in conjunction with the stems 21 forms a recess shaped essentially as an annular groove, in which the ring 4 is inserted under tension. The ring 4 is made of an elastic and relatively soft material, for example thermoplastic polyolefins, polyethylene, polypropylene, TBE-EPDM, rubber or a comparable material and has a Shore value of approximately 70, or even more than 70. The ring 4 can optionally also be made of a transparent or expanded material.

As seen in FIG. 1, the inside diameter of the ring 4 is somewhat smaller than the outside diameter of the striking cap 3, or optionally of a compression ring 35 or 36. The ring 4 can then be manually pushed over the striking cap 3 from the front by a rolling motion, in particular, without applying a tool, until the position of the ring 4 is fixed, for example locked, in the intended position. The pretension holds the ring 4 securely in its position on the shuttlecock 1, in particular when forcefully struck by, for example, a squash racket and the like (squash class (140 to 220 grams); heavy balls also with tennis rackets, 250 to 350 grams).

Moreover, the outside diameter of the ring 4 is in this embodiment slightly greater than the outside diameter of the striking cap 3. This enhances the visibility of the shuttlecock. In particular, an approaching shuttlecock can be identified earlier.

For example, the inside diameter of the ring 4 can be approximately 21 mm; the outside diameter can be approximately 30 mm or may even approach 70 mm; and the circle defining the toroidal shape can have a diameter between approximately 1 and 15 mm, for example approximately 5 mm. These dimensions are suitable for a striking cap 3 or optionally for a compression ring 35, 36 with a diameter of approximately 26 mm. The end ring 27 can then have a diameter of, for example, approximately 19 mm. The rear opening of the crown 2, i.e., the diameter of the base area of the straight circular cylinder defining the coarse shape of the crown, can then have a diameter of approximately 50 mm, and the crown can have a the length of approximately 35 mm, as measured from the rear boundary of the end plate 27 to the rear circular opening of the crown 2 along the major axis.

Figure 4A:
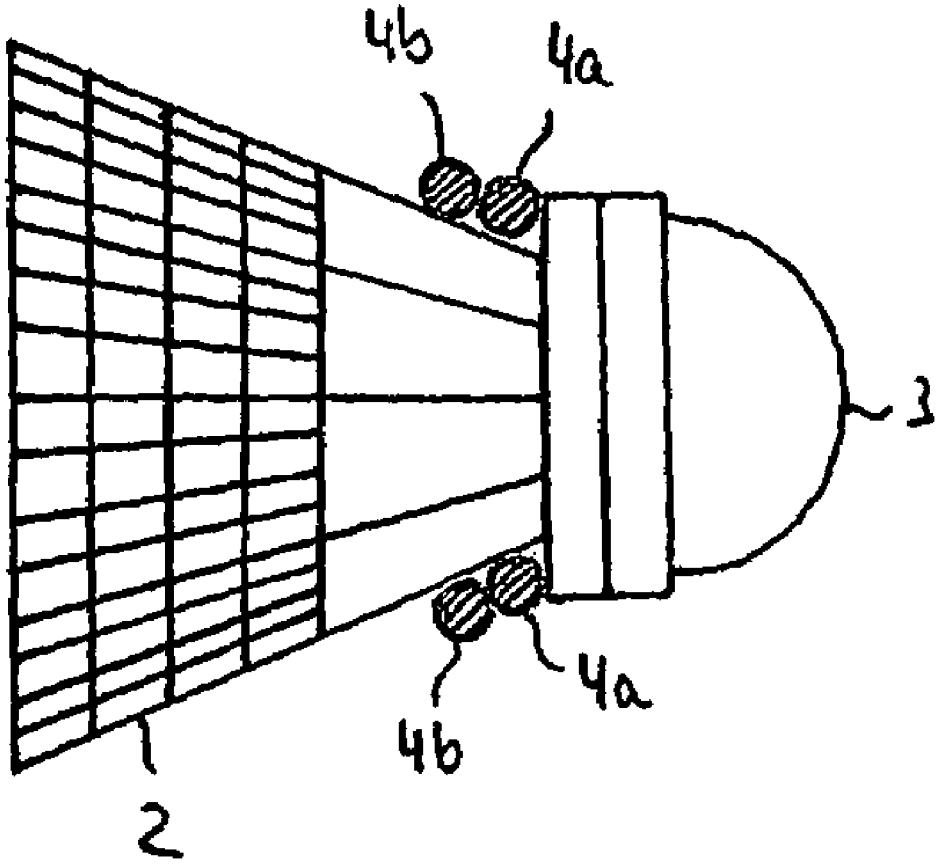
FIG. 4*a* shows a shuttlecock according to the invention with two identical rings being applied.

According to this embodiment, two or three identical rings 4*a*, 4*b* may also be placed on the shuttlecock 1, as indicated schematically in FIG. 4*a* in a diagram similar to that of FIG. 1. The application of various weights can then advantageously influence and facilitate the flight characteristic and handling of the shuttlecock 1.

Figure 4B:
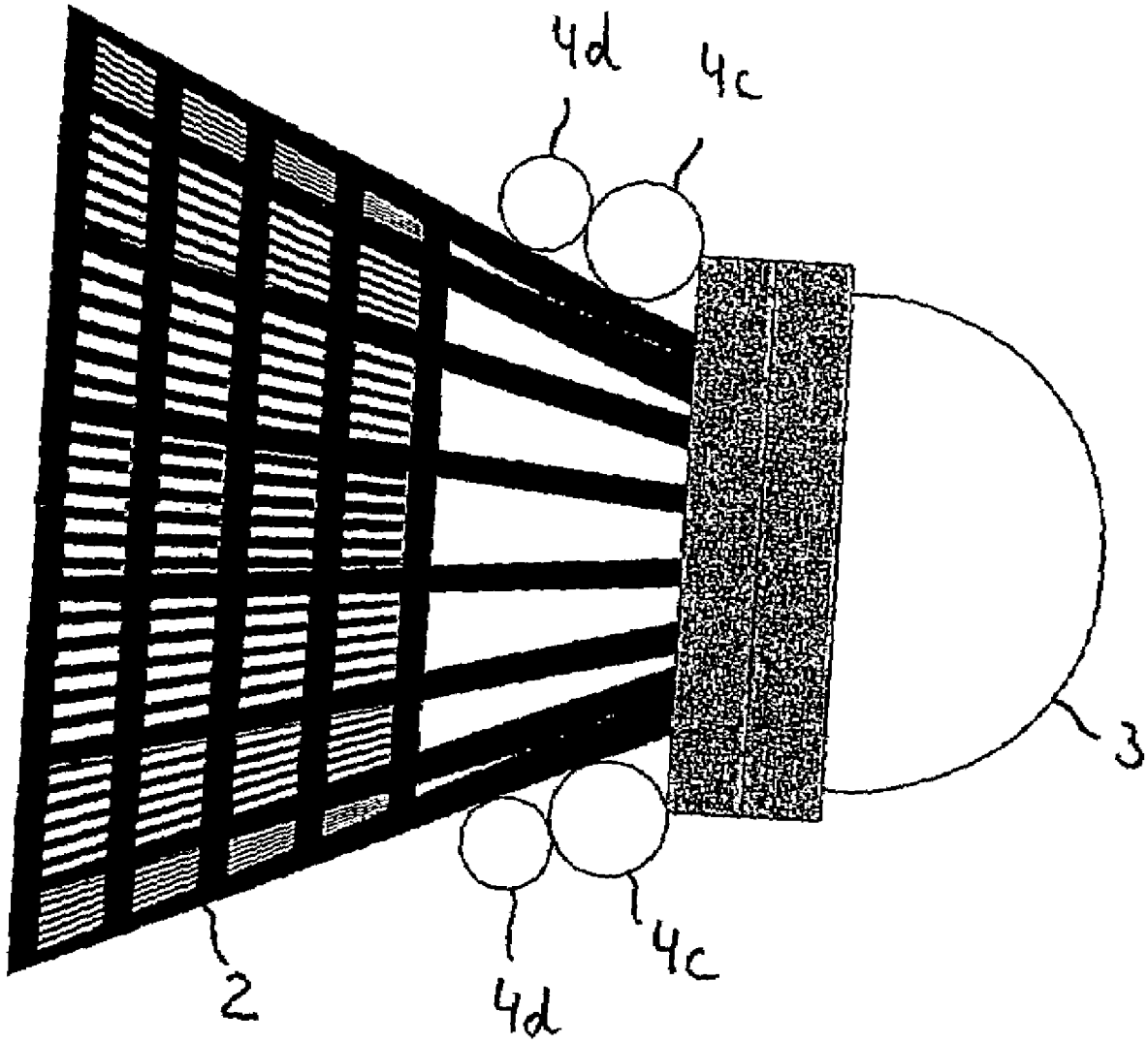
FIG. 4*b* shows a shuttlecock according to the invention with two different rings.

Alternatively, two or more rings 4*c*, 4*d* represented by toroids of different diameter and thickness, but identical material, can be applied, as indicated schematically by the two exemplary rings 4*c*, 4*d* in FIG. 4*b*. For example, a toroidal front ring 4*c* can have a greater thickness than an abutting rear ring 4*d*; this can improve the aerodynamic performance. The diameter of the front ring 4*c* can also be smaller than the diameter of the rear ring 4*d*; such arrangement can conform better to the conical shape of the crown and, more particularly, relieve excess pressure on the crown 2 produced by the rear ring 4*d*. Those skilled in the art will appreciate that numerous additional variations can be implemented. For example, the rings may have different material properties, for example elastic properties, so that a ring with greater elasticity can be used in the back of a ring with smaller elasticity to better adapt to the conical shape of the crown.

The increased weight can increase the inertia of the shuttlecock 1 and thus improve its stability. In particular, the sideways drift from the original trajectory may be reduced in crosswinds. In addition, the increased weight or the increased inertia of the shuttlecock can increase the maximum speed of the shuttlecock 1, resulting in a greater range.

For example, the ring 4 can weigh approximately 2 grams or more, with the shuttlecock 1 without the applied ring weighing approximately 9 grams.

According to the aforedescribed exemplary embodiment, placement of the ring 4 according to the invention distributes the ring weight symmetrically relative to the main symmetry axis of the shuttlecock 1, which produces a predictable, uniform effect on the flight characteristic. The "addition of the mass" is here symmetric and balanced.

In conformance with the dimensions listed above, the (outside) diameter of the ring 4 (30 mm) can be greater than the (outside) diameter of the striking cap 3 (26 mm). This can improve the visibility of the shuttlecock 1, in particular when the ring 4 is colored or has a luminous or signal color. For example, an approaching shuttlecock can then be distinguished earlier and/or better than a comparable shuttlecock without a ring.

As mentioned above, the ring(s) can also have different features, such as different densities and/or different diameters. For example, a ring with a slightly greater diameter can be arranged in the rear of a ring with a slightly smaller diameter. This arrangement is better adapted to the conical shape of the crown and can prevent excess deformation or compression of the stems 21 in this region produced by the tension of the ring(s).

When using a conventional shuttlecock, vortices can develop during flight in the region of the rear outer edge 37 (see FIG. 2*a*), which can impair the flight characteristic and, more particularly, reduce the speed of the ball. These vortices can be neutralized by using the ring 4, eliminating at least partially the detrimental vortex forces.

Figure 2C:
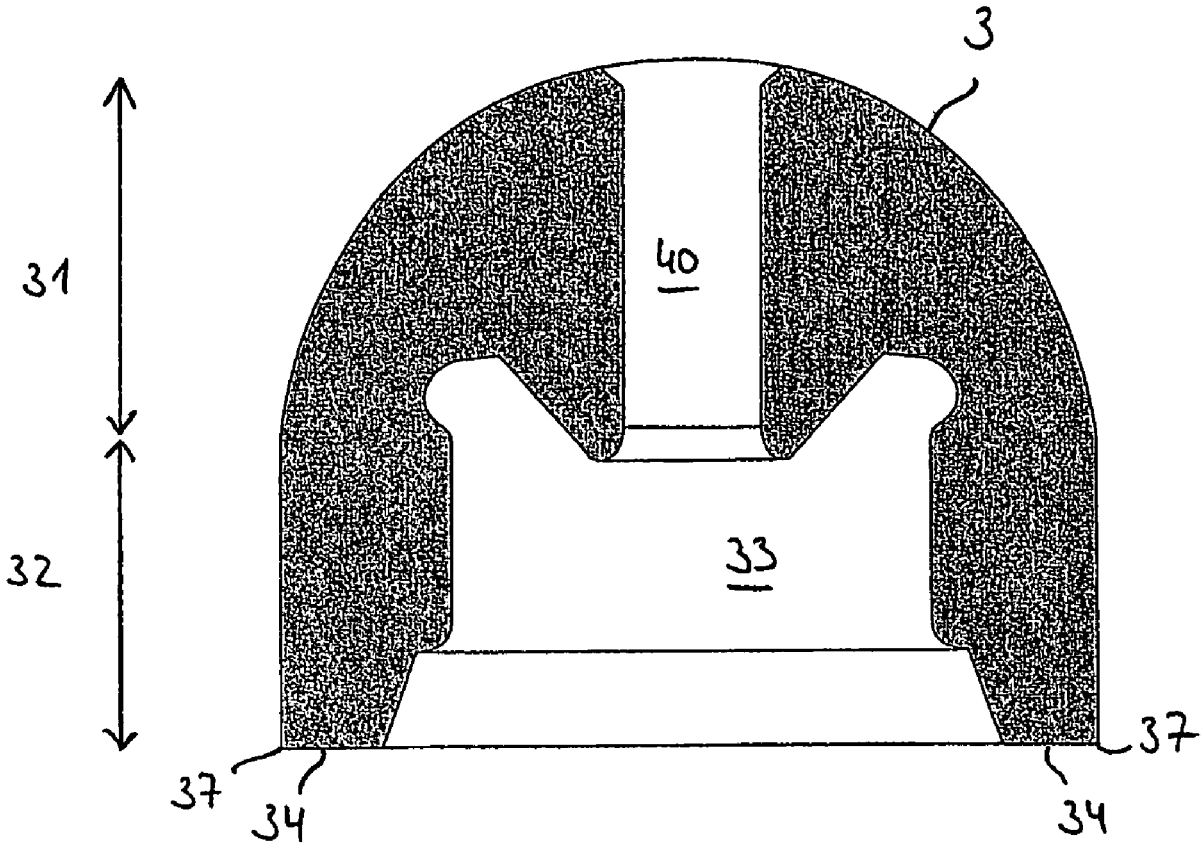
FIG. 2*c* shows a cross-sectional view of a striking cap.
Figure 3A:
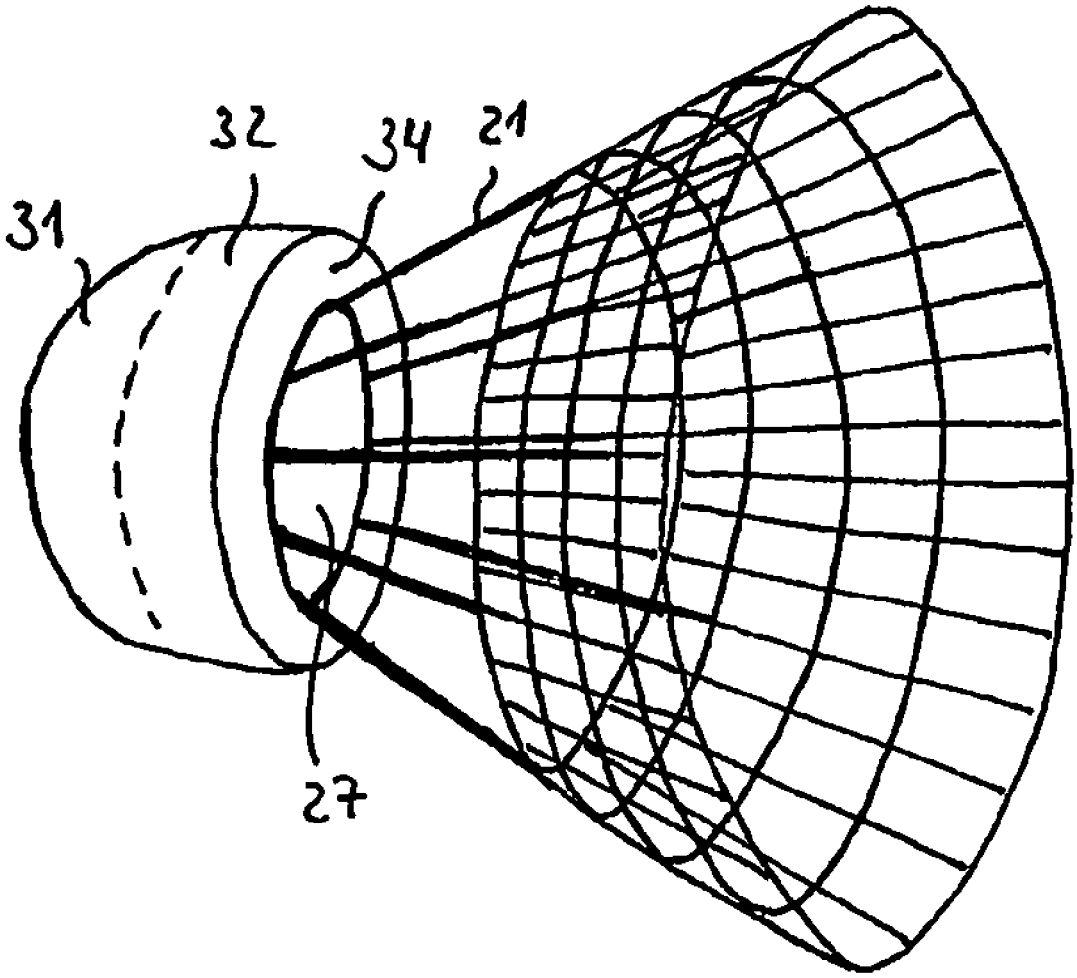
FIG. 3*a* shows schematically a perspective view of a conventional shuttlecock.
Figure 3B:
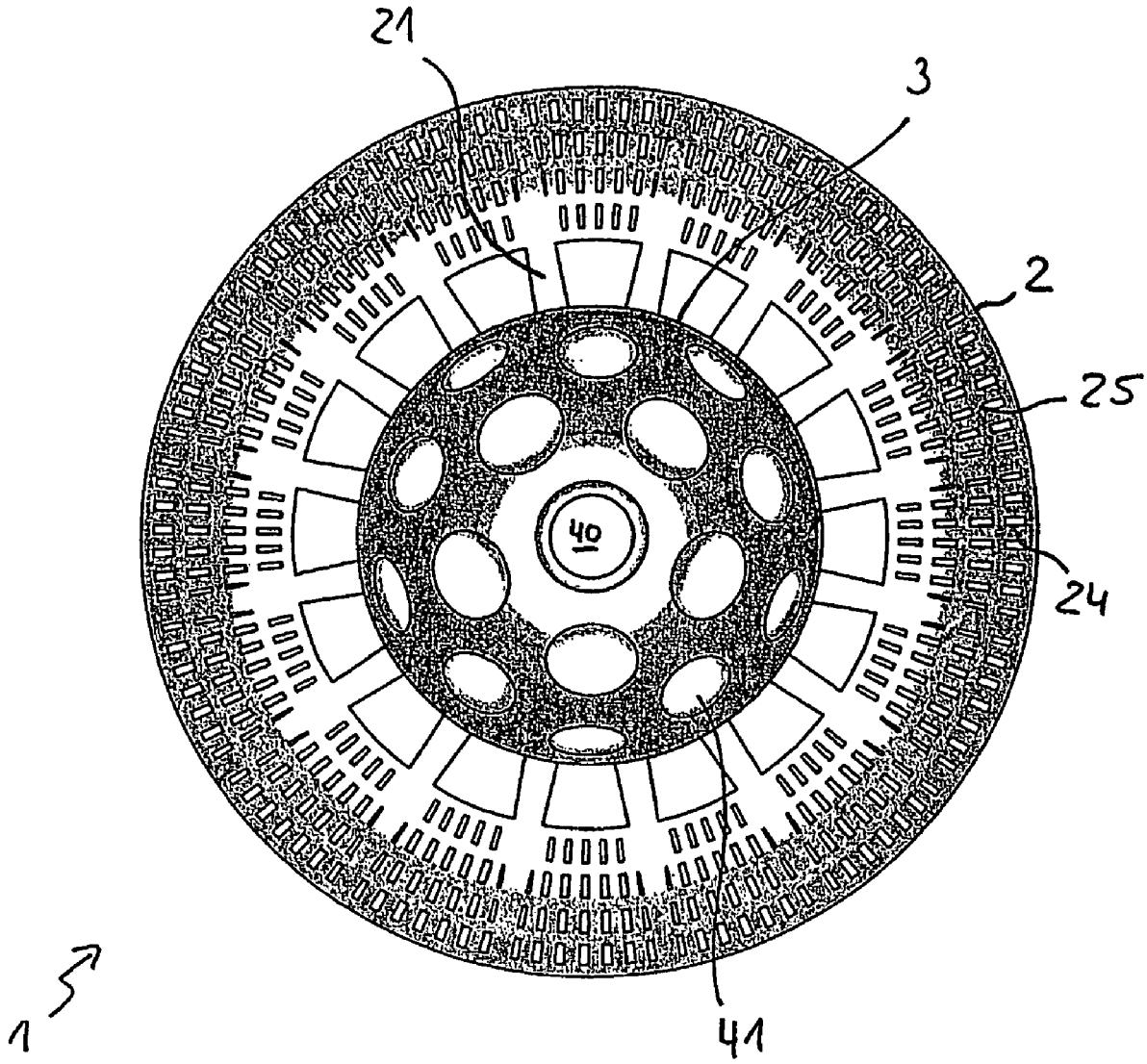
FIG. 3*b* shows a front view of a shuttlecock.
Figure 5A:
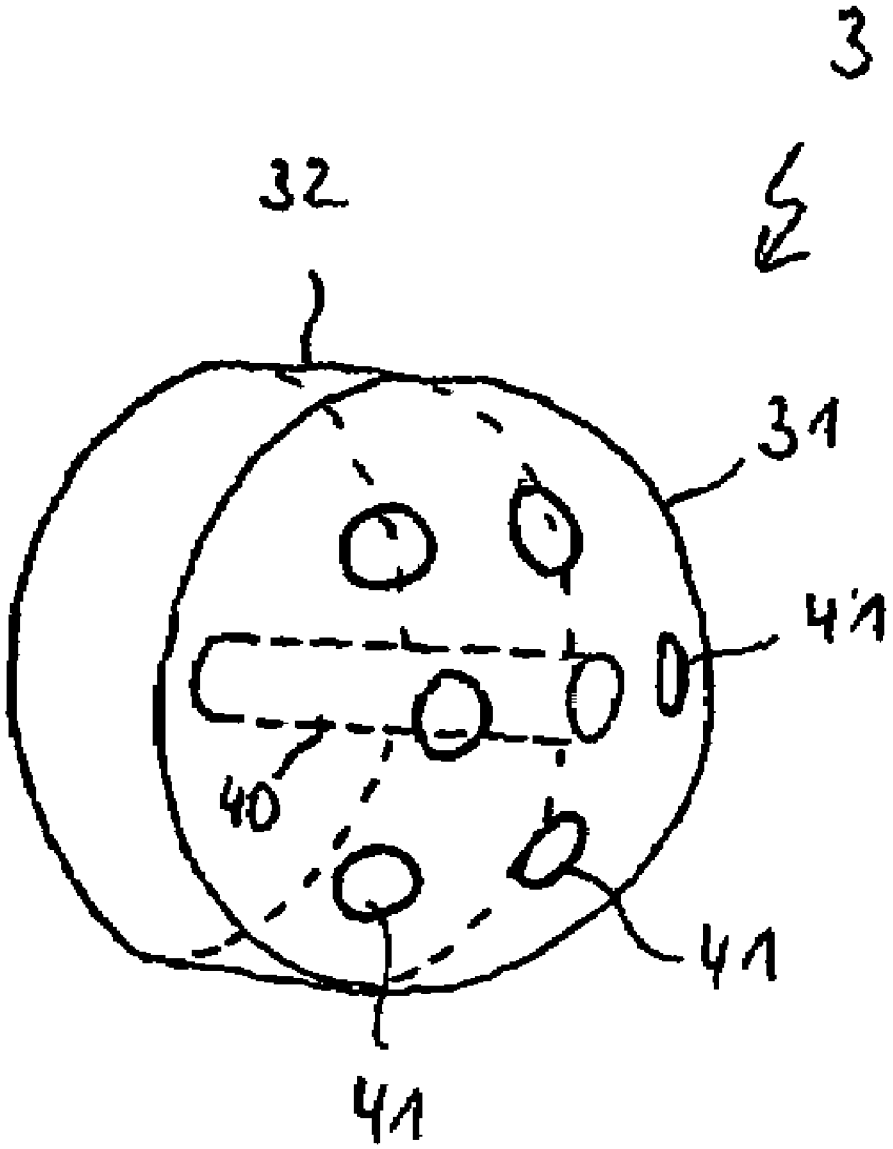
FIG. 5*a* shows schematically a perspective, partially transparent view of a striking cap with a hole and dimples.
Figure 5B:
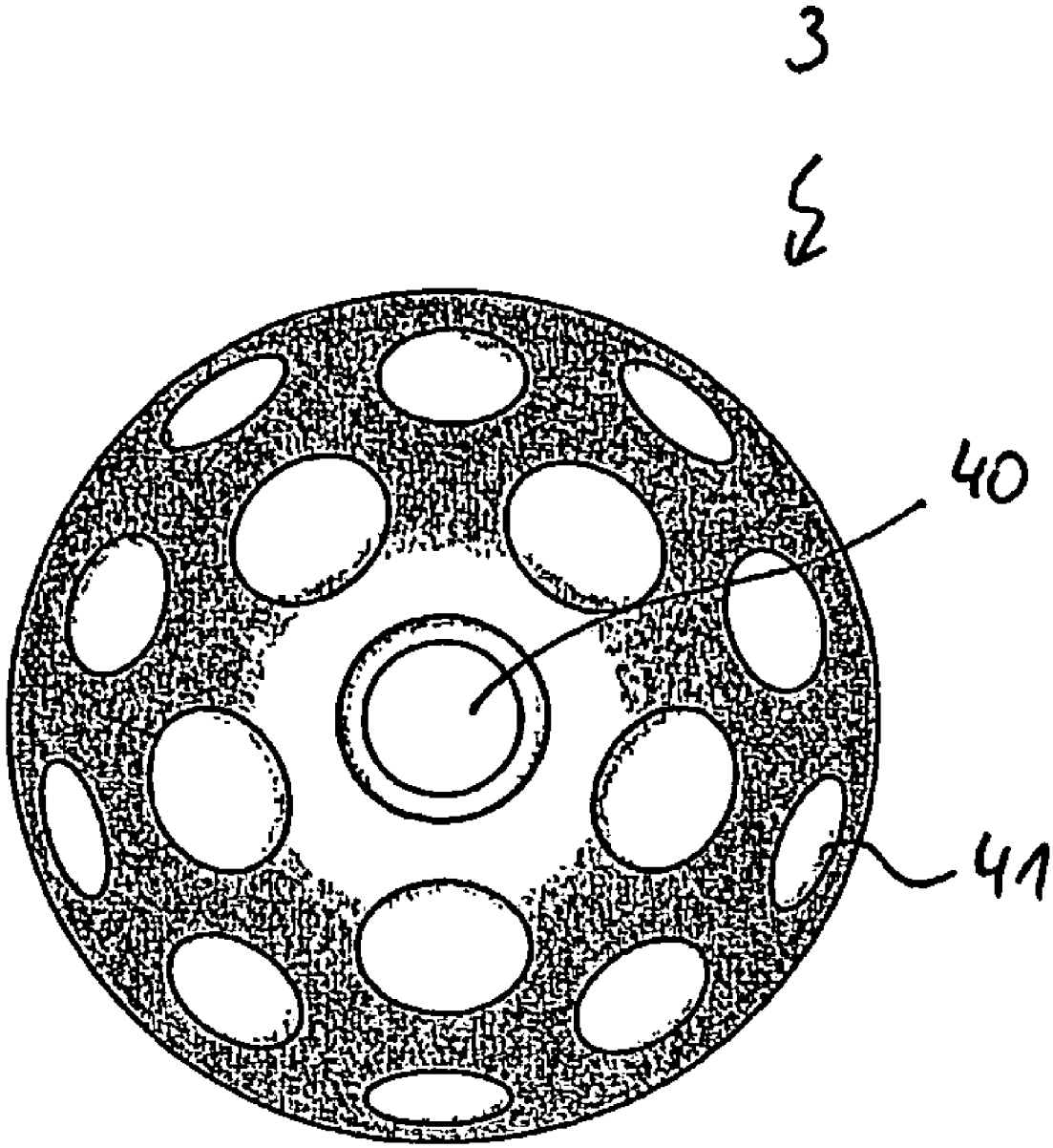
FIG. 5*b* shows a front view of a striking cap with a hole and dimples.

FIGS. 5*a, b* show schematically in a partially transparent diagram a central hole 40 arranged, for example, in the striking cap 3 symmetric to the symmetry axis of the shuttlecock 1 and having a diameter of approximately 4 mm. (An opening 33 is not shown in FIG. 5*a* so as not to overcomplicate the drawing). This arrangement is also illustrated in FIGS. 2*c* and 3*b*. Accordingly, the hole 40 can be extended in the end plate 27 to the back (not shown). The hole 40 can generate acoustic resonances in flight, for example a whistling sound. Such acoustic stimuli can further broaden the applications of the shuttlecock in ballgames.

In addition, dimple-like indentations 41 can be applied on the surface of the dome-shape front side 31 of the striking cap 3 so as to further improve the aerodynamic properties, as generally known in the art. FIG. 5*a* shows schematically six indentations. In total, approximately 16 or more dimples may be applied.

Figure 6:
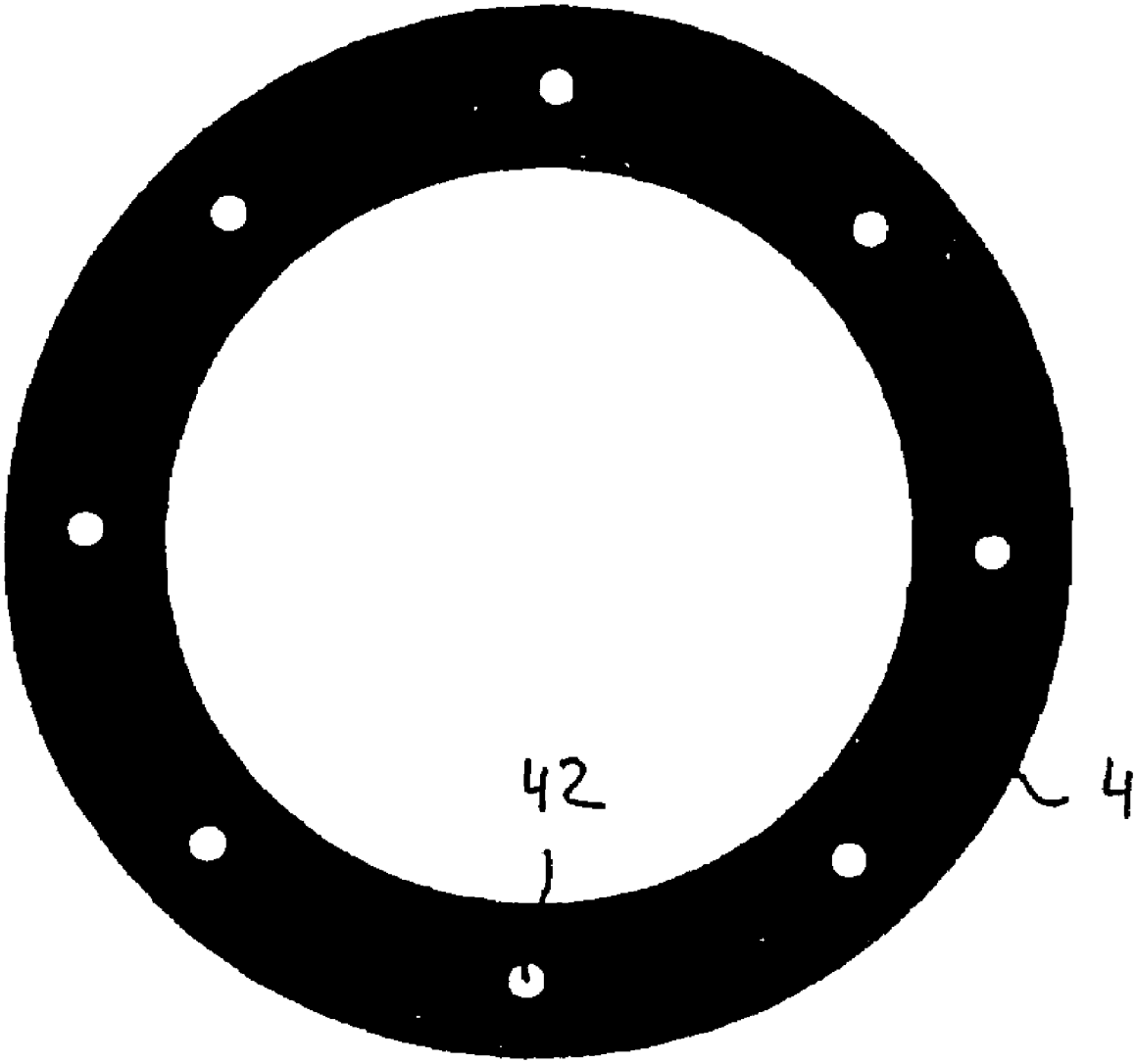
FIG. 6 shows a ring with holes.

Alternatively or in addition to the central hole 40 located in the striking cap 3, the ring 4 can also have several corresponding holes 42, as shown in FIG. 6 depicting eight exemplary holes 42. This arrangement, also referred to as "sonar ring", also produces similar acoustic resonances. The holes 42 in ring 4 can have longitudinal axes oriented, at least substantially, parallel to the flight trajectory. Such holes 42 can also be used to apply small additional weights, referred to as "weight sticks", which enhances the options for applying weights to the shuttlecock. Self-illuminating elements, also referred to as "light sticks", may also be inserted into the holes 42 on the shuttlecock.

Figure 7A:
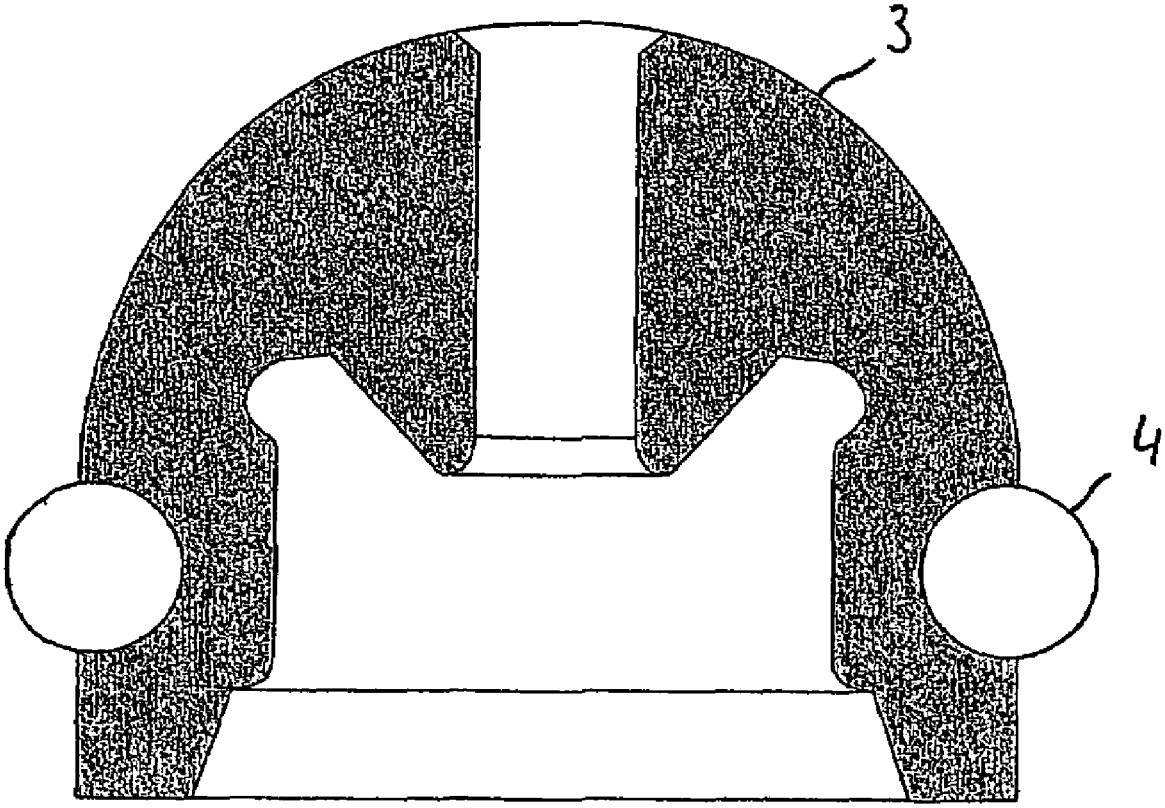
FIG. 7*a* shows a striking cap with one ring.
Figure 7B:
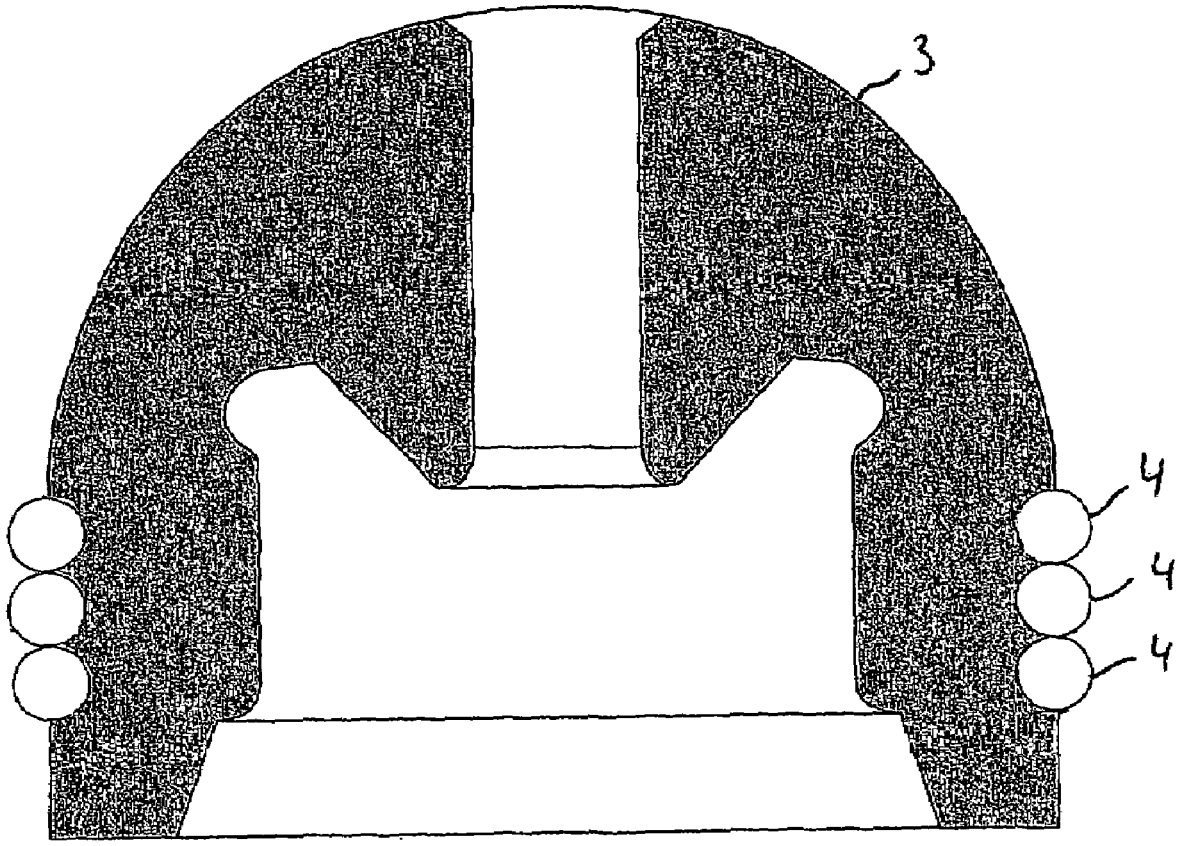
FIG. 7*b* shows a striking cap with several rings.

Finally, FIG. 7*a* shows an optional recess on the striking cap 3 in the form of an annular groove adapted to receive the ring 4 and hold the ring 4 in position. A similar arrangement can be used with several rings, as shown for three rings 4 in the example depicted in FIG. 7*b*.

The advantages of the invention can be summarized as follows.

The flight characteristic of the shuttlecock can be changed easily, rapidly and in numerous ways.

No tool is required to change the flight characteristic.

In general, the aerodynamic properties of the shuttlecock, in particular under "outdoor conditions," are significantly improved. The ballgame can therefore be played even at wind strengths of approximately 5 Beaufort (29-38 km/h).

The flight characteristic can be adapted individually to the training level of the player (from "beginner" to "professional").

The early visibility of the shuttlecock is significantly improved.

Acoustic stimuli can be produced which further enrich the possibilities for employing the shuttlecock in ballgames.

| This of reference symbols | |
|---|---|
| 1 | shuttlecock (shuttle) |
| 2 | crown (skirt) |
| 3 | striking cap |
| 4 | toroidal ring |
| 4a, b, c, d | several rings, in part with different dimensions/materials |
| 20 | front crown section |
| 21 | stems |
| 22 | rear crown section |
| 24 | connecting ribs |
| 25 | ribs |
| 26 | cylindrical fastening pin |
| 27 | end ring (ring) |
| 31 | dome-shaped front striking cap section |
| 32 | cylindrical rear striking cap section |
| 33 | striking cap opening |
| 34 | rear wall of the striking cap |
| 35 | front compression ring |
| 36 | rear compression ring |
| 37 | rear outer edge of the striking cap |
| 40 | striking cap hole |
| 41 | indentations |
| 42 | holes in the ring, "sonar ring" |

The invention claimed is:

1. Shuttlecock, comprising an approximately conical crown, wherein the crown includes an integrally formed fastening element disposed in a region of the small end of the crown, a striking cap, which is essentially dome-shaped at least in a front section, when viewed in the flight direction, and which is anchored in the fastening element, and at least one ring which is releasably attached to the crown such that the ring surrounds the crown and is being pretensioned by the conical crown and by a rear boundary wall of the striking cap.

2. Shuttlecock according to claim 1, wherein the at least one ring is made of an elastic material.

3. Shuttlecock according to claim 1, wherein an inside diameter of the at least one ring is smaller than an outside diameter of the striking cap.

4. Shuttlecock according to claim 1, wherein the outside diameter of the at least one ring is greater than the outside diameter of the striking cap.

5. Shuttlecock according to claim 1, wherein the at least one ring is made of one chosen from the group consisting of thermoplastic polyolefins, polyethylene, polypropylene, EPDM, TBE-EPDM, and rubber.

6. Shuttlecock according to claim 1, wherein the at least one ring has a substantially toroidal surface.

7. Shuttlecock according to claim 1, wherein the at least one ring has a weight of approximately between 10 and 70 percent of the weight of the shuttlecock without the at least one ring being installed.

8. Shuttlecock according to claim 1, wherein the at least one ring has a weight of approximately between 1 and 25 grams.

9. Shuttlecock according to claim 1, wherein the material of the at least one ring has a Shore value in the range of approximately 40 to 90.

10. Shuttlecock according to claim 1, wherein the at least one ring has an outside diameter of approximately 25 to 70 mm and an inside diameter of approximately 15 to 40 mm.

11. Shuttlecock according to claim 1, wherein the exterior surface of the crown has a length of approximately between 33 and 43 mm and the striking cap has a diameter of approximately between 20 and 30 mm, and in addition the crown has approximately the shape of a straight truncated cone and the surface of the base covered by the cone has a diameter of approximately 45 to 55 mm.

12. Shuttlecock according to claim 1, further comprising several rings, which are made of the same material and have the same dimensions.

13. Shuttlecock according to claim 1, further comprising several rings, having at least one characteristic from the group consisting of different dimensions and being made of materials having different densities.

14. Shuttlecock according to claim 1, wherein the at least one ring is at least one of capable of emitting light and equipped with ornamental light sticks.

15. Shuttlecock according to claim 1, wherein an opening is provided in the striking cap, so that acoustic resonances can be produced by an impinging airflow.

16. Shuttlecock according to claim 1, wherein the material of the at least one ring has a Shore value of approximately 70.

17. Shuttlecock according to claim 1, further comprising two to four rings, which are made of the same material and have the same dimensions.

* * * * *